US006415128B1

(12) United States Patent
Takagi et al.

(10) Patent No.: US 6,415,128 B1
(45) Date of Patent: Jul. 2, 2002

(54) FIXING DEVICE

(75) Inventors: Osamu Takagi, Chofu; Satoshi Kinouchi, Tokyo, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/036,503

(22) Filed: Jan. 7, 2002

Related U.S. Application Data

(62) Division of application No. 09/667,782, filed on Sep. 22, 2000, now Pat. No. 6,337,969.

(30) Foreign Application Priority Data

Sep. 22, 1999 (JP) ..... 11-269261

(51) Int. Cl.[7] ..... G03G 15/20
(52) U.S. Cl. ..... 399/335; 219/619
(58) Field of Search ..... 399/336, 330, 399/335, 67, 88; 219/619, 636, 672, 661, 216

(56) References Cited

U.S. PATENT DOCUMENTS 6,026,273 A 2/2000 Kinouchi et al. ..... 399/328
6,078,033 A * 6/2000 Bowers et al.
6,078,781 A 6/2000 Takagi et al. ..... 399/330
6,087,641 A 7/2000 Kinouchi et al. ..... 219/619
6,097,926 A 8/2000 Takagi et al. ..... 399/328
6,121,592 A * 9/2000 Fishman et al. ..... 219/661
6,137,985 A 10/2000 Kinouchi et al. ..... 399/329
6,154,629 A 11/2000 Kinouchi et al. ..... 399/329
6,252,212 B1 6/2001 Takagi et al. ..... 219/619
6,255,633 B1 7/2001 Takagi et al. ..... 219/619
6,278,852 B1 * 8/2001 Hayashi ..... 219/216

FOREIGN PATENT DOCUMENTS

JP 59-33476 2/1984
JP 8-76620 3/1996

* cited by examiner

*Primary Examiner*—Susan S. Y. Lee
(74) *Attorney, Agent, or Firm*—Foley & Lardner

(57) ABSTRACT

A fixing device having a heat roller which is adapted to be moved at the same velocity as the transferring speed of a paper with an image thereon and is adapted to be contacted with the paper to thereby enable the image on the paper to be thermally fixed, and an induction heating mechanism for performing an induction heating of the heat roller. The induction heating mechanism having a coil, and a supporter for supporting the coil, and the coil is constituted by a plurality of litz wir which are designed to be altered in the manner of combination or of connection thereof, thereby enabling a plurality of different electric voltages to be applicable.

3 Claims, 7 Drawing Sheets

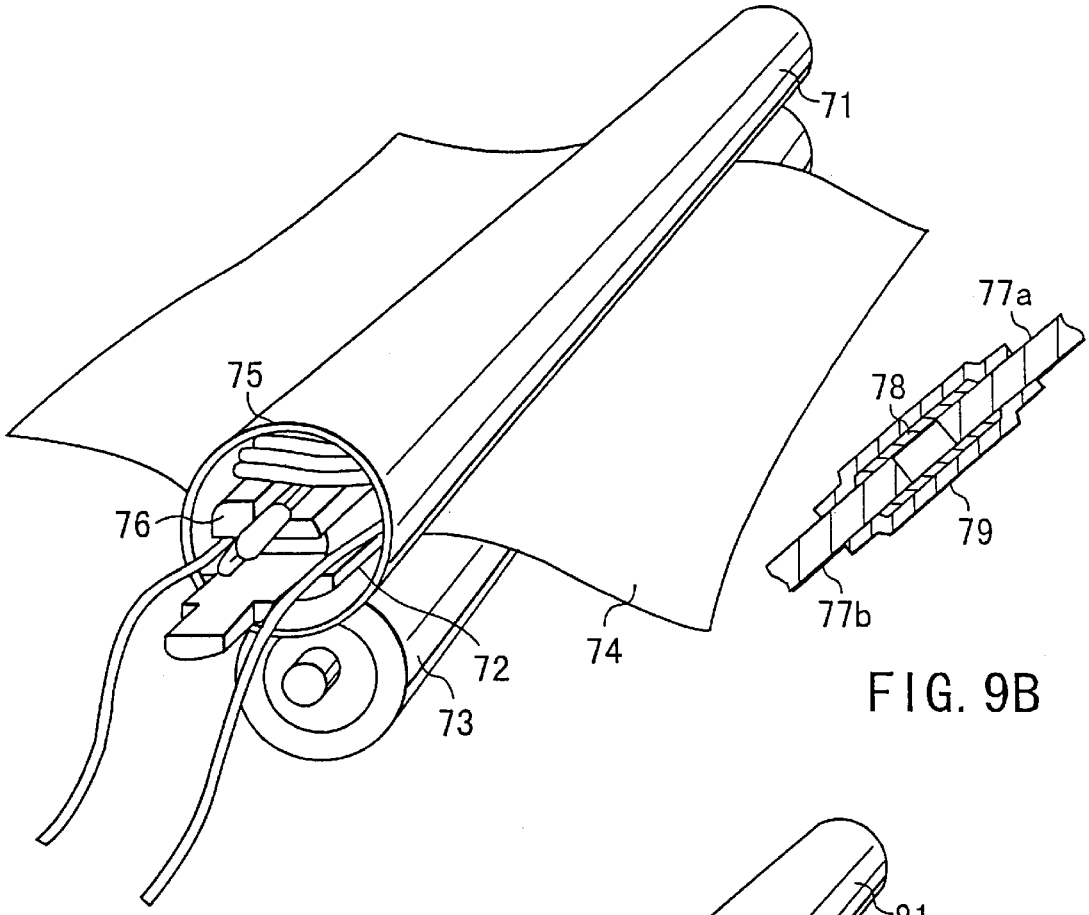
FIG. 9B
FIG. 9A
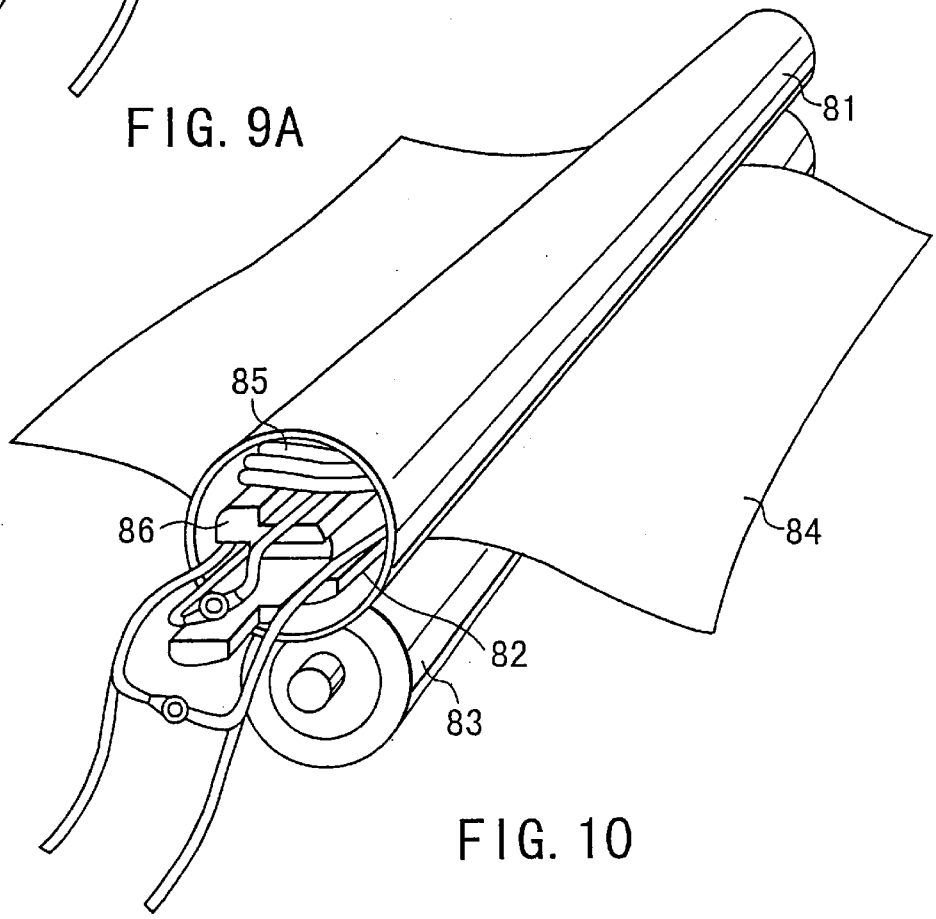
FIG. 10

FIXING DEVICE

CROSS-REFERENCE TO RELATED APPLICATIONS

This application is a divisional of U.S. Ser. No. 09/667,782 filed Sep. 22, 2000, which is based upon and claims the benefit of priority from the prior Japanese Patent Application No. 11-269261, filed Sep. 22, 1999, now U.S. Pat. No. 6,337,969, the entire contents of which are incorporated herein by reference.

BACKGROUND OF THE INVENTION

The present invention relates to a fixing device for an image-forming apparatus, and in particular, to a fixing device for an electrophotographic apparatus where induction heating is employed as a heating source.

According to the conventional fixing device of electrophotographic apparatus, the fixing is generally performed as follows. Namely, a halogen lamp is employed as a heating source, wherein the halogen lamp is disposed inside a metal roller to heat the roller, and an elastic roller is pressed onto the metal roller with a sheet-like material with an unfixed image (a material which is subjected to the fixing, such as paper) interposed therebetween, thereby press-contacting the sheet-like material onto the metal roller. These rollers are then rotated and the sheet-like material is passed through an interface between these rollers. Alternatively, a method of heating the roller in a non-contact manner by making use of a flush lamp is also put to practical use.

FIG. 1 schematically illustrates the entire structure of the conventional fixing device. Namely, the fixing device for electrophotography is generally constituted by a heating roller 1 formed of a thin wall metal roller and housing therein a halogen lamp heater 2 as a heating source, and a pressing roller 3 having an elastic surface layer for bringing a sheet-like material into sufficient contact with the heating roller 1. These heating roller 1 and pressing roller 3 are supported by means of a pressing mechanism (not shown) so as to ensure a predetermined contacted width therebetween, and are also made rotatable by means of a driving source (not shown) so as to make the peripheral speed of these two rollers identical with the transferring speed of the sheet-like material.

According to the conventional fixing device of this system, since the heating roller is heated by making use of a lamp, the heat efficiency thereof is at most about 70%. Additionally, since the heating roller is constructed such that it is heated from the inside thereof, the heating roller is accompanied with various problems that the kick-off property of temperature is poor, that the structure thereof is rather complicated, and that it is difficult to miniaturize the heating roller.

With a view to improve the efficiency of the fixing device, there have been proposed a fixing device wherein a magnetic field-generating means is combined with a belt so as to utilize a induction heating (Japanese Patent Unexamined Publication H8-76620), and a fixing device wherein ceramics is employed as a heating member (Japanese Patent Unexamined Publication S59-33476).

Among these fixing devices, the fixing device which takes advantage of induction heating is defective in that, since the induction heating is incapable of realizing a uniform heating, a non-uniform temperature distribution would be generated on the surface of the roller, and due to this non-uniform thermal load, the roller may be damaged. If this problem is to be overcome, any member to which toner is more likely to adhere among the members which contact with the outer surface of the fixing roller is required to be heated prior to initiating the rotational movement of the fixing roller.

Further, for the purpose of optimizing the exothermic efficiency by optimizing the impedance, the construction of the coil is required to be optimized. The optimization of exothermic efficiency leads to the effect of saving the energy.

Meanwhile, according to the conventional fixing device where a halogen lamp is utilized as a heating source, the non-uniformity of temperature in the axial direction of the heating roller has been overcome by changing the light distribution property of the lamp. However, it is also required to cope with this non-uniformity of temperature even in the fixing device utilizing induction heating.

BRIEF SUMMARY OF THE INVENTION

An object of the present invention is to provide a fixing device for fixing an image of developer (which is referred hereinafter to as a fixing device), which is capable of optimizing the exothermic efficiency, capable of uniformly heating the heating roller, and capable of being manufactured cheaply.

According to the present invention, there is provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the supporting member has a frame structure which is partitioned into a plurality of sections which are partitioned in a direction perpendicular to the transferring direction of the sheet-like member.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the coil member is constituted by a plurality of coil components which are connected with each other in such a manner that an electric voltage between a connecting terminal of a first coil component and a connecting terminal of a second coil component disposed next to the first coil component is smaller than an electric voltage between a connecting terminal of a first coil component and a connecting terminal of a third coil component disposed not neighboring to the first coil component.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the coil member is provided with a pair of lead wires for connecting it with a driving circuit for driving the coil member, said pair of lead wires being drawn out in one direction which is perpendicular to the transferring direction of the sheet-like member.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the coil member is constituted by a plurality of coil components which are connected with each other using a crimp-style terminal on one side in a direction perpendicular to the transferring direction of the sheet-like member, the connected portion of said coil components being undergone with an insulating treatment and bent inside said coil member.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; that the supporting member is provided with at least one tapering portion or step portion which is formed along a direction perpendicular to the transferring direction of the sheet-like member, and that the coil member is provided with at least one tapering portion or step portion which is formed in conformity with the tapering portion or step portion formed on said supporting member.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and that the coil member is constituted by a plurality of litz wires which are designed to be altered in the manner of combination or of connection thereof, thereby enabling a plurality of different electric voltages to be applicable.

According to the present invention, there is also provided a fixing device comprising an endless heating member which is adapted to be moved at the same velocity as the transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the coil member has a central space, whose width is varied along a direction perpendicular to the transferring direction of the sheet-like member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 9A is a perspective view illustrating a main portion of the fixing device according to Example 6;

FIG. 9B is a cross-sectional view illustrating a connected portion between electric wires in the fixing device according to Example 6;

FIG. 10 is a perspective view illustrating a main portion of the fixing device according to Example 7;

DETAILED DESCRIPTION OF THE INVENTION

Figure 1:
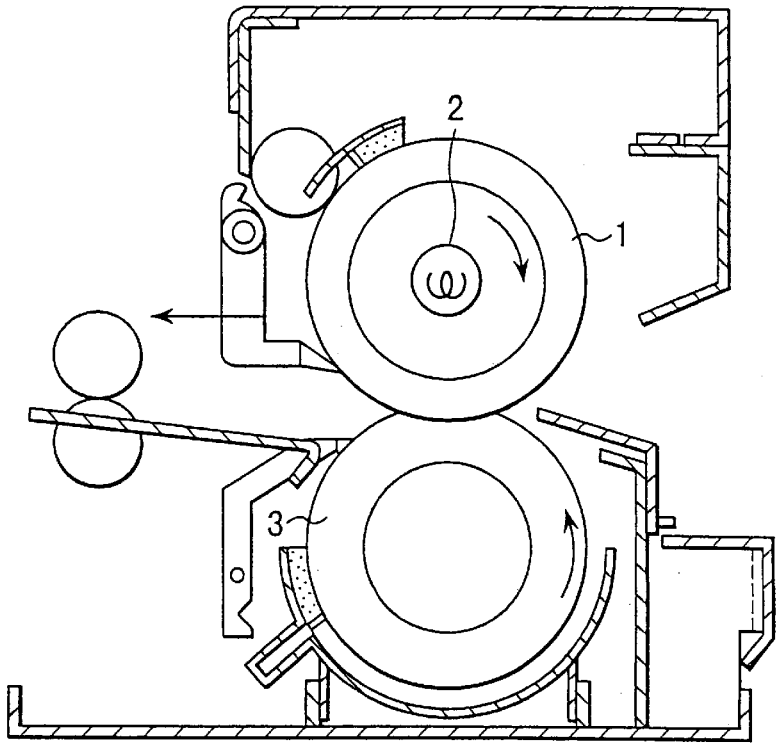
FIG. 1 is a cross-sectional view illustrating a fixing device of the prior art.

Various embodiments of the present invention will be explained with reference to the drawings.

A first embodiment of this invention is featured in that the supporting member has a frame structure which is partitioned into a plurality of sections which are partitioned in a direction perpendicular to the transferring direction of the sheet-like member. When the supporting member is constructed in this manner, the volume of expensive heat resistant material can be minimized, thereby making it possible to save the manufacturing cost, to lower heat capacity, and hence to accelerate the kick-off time to thereby prevent the temperature of electric wires from excessively rising. Additionally, the combination of the sections of the partitioned frame structure can be easily altered, thus making it possible to alter the characteristics of coil.

A second embodiment of this invention is featured in that the coil member is constituted by a plurality of coil components which are connected with each other in such a manner that an electric voltage between a connecting terminal of a first coil component and a connecting terminal of a second coil component disposed next to the first coil component is smaller than an electric voltage between a connecting terminal of a first coil component and a connecting terminal of a third coil component disposed not neighboring to the first coil component. When the coil member is constructed in this manner, the insulating treatment which is required for ensuring the safety of device can be simplified, thus making it possible to save the manufacturing cost and to miniaturize the coil.

A third embodiment of this invention is featured in that the coil member is provided with a pair of lead wires for connecting it with a driving circuit for driving the coil member, said pair of lead wires being drawn out in one direction which is perpendicular to the transferring direction of the sheet-like member. When the coil member is constructed in this manner, a member for preventing the generation of noise from the lead wires can be concentratedly disposed on only one side. Further, when the lead wires are drawn out closer to the driving circuit, the fixing device can be further miniaturized.

A fourth embodiment of this invention is featured in that the coil member is constituted by a plurality of coil components which are connected with each other using crimp-style terminals on one side in a direction perpendicular to the transferring direction of the sheet-like member, the connected portion of said coil components being undergone with an insulating treatment and bent inside said coil member. When the coil member is constructed in this manner, the following effects can be obtained.

Namely, on the occasion of connecting a plurality of coils with each other, since this connecting work is performed after finishing the molding work of the coil, the peel-off of the cladding of lead as well as the connection of leads by making use of a press-contacting tool are required to be performed at a position spaced away from the coil, thus giving rise to the generation of noise as in the case of lead wires. However, when this connecting portion is concentratedly disposed on one side, a member for preventing the noise can be concentratedly disposed only on one side. Further, when the lead wires are disposed on the side which is closer to the driving circuit, the fixing device can be miniaturized.

It is also possible to greatly simplify the member to be employed for preventing the generation of noise, and to miniaturize the connecting member. Furthermore, it is possible to improve the safety property of the fixing device against the generation of leak current that might be caused due to the contact of the coil-connecting portion with other coils, conductive supporting members or noise-preventing members.

A fifth embodiment of this invention is featured in that the supporting member is provided with at least one tapering portion or step portion which is formed along a direction perpendicular to the transferring direction of the sheet-like member, and that the coil member is provided with at least one tapering portion or step portion which is formed in conformity with the tapering portion or step portion formed on said supporting member. When the supporting member is constructed in this manner, the temperature of the roller can be controlled to a desired range, thereby making it possible to stabilize the fixing performance of the fixing device.

A sixth embodiment of this invention is featured in that the coil member is constituted by a plurality of litz wires which are designed to be altered in the manner of combination or of connection thereof, thereby enabling a plurality of different electric voltages to be applicable. When the coil member is constructed in this manner, the method and procedures of molding the coil, as well as the mold thereof can be utilized in common, thereby making it possible to reduce the manufacturing cost of the fixing device.

A seventh embodiment of this invention is featured in that the coil member has a central space, whose width is varied along a direction perpendicular to the transferring direction of the sheet-like member. When the coil member is constructed in this manner, the exothermic pattern can be altered depending on the heat capacity of the roller, thereby making it possible to realize a uniform heating of the roller.

Followings are various specific embodiments of this invention.

(1) In the aforementioned first embodiment, the plural sections of the supporting member have different profiles.

(2) In the aforementioned first embodiment, the frame structure is constructed such that it is linked in the direction perpendicular to the moving direction of the endless heating member.

(3) In the aforementioned item (2), the connecting member is disposed at a position facing the center of winding of the coil.

(4) In the aforementioned second embodiment, where the coil member is formed of a multi-layer structure, the potential difference between electric wires disposed neighboring each other within the same layer is at least lower than the potential difference thereof relative to other electric wires.

(5) In the aforementioned item (4), the coil-supporting member is functioned as an insulating member against other layers.

(6) In the aforementioned item (4), an insulating member is interposed between different layers.

(7) The insulation is formed of a 2 or more-ply structure.

(8) In the aforementioned third embodiment, said one side is the side which is closer to the driving circuit.

(9) In the aforementioned fourth embodiment, the connecting portion is directed in the same direction as the direction of the connecting wire extended to the driving circuit.

(10) In the aforementioned fourth embodiment, where the coil member is constituted by a combination of a plurality of coil components, and the width of the space portion is enabled to alter in at least one coil components.

(11) In the aforementioned first to seventh embodiments, the endless heating member is a roller.

EXAMPLE 1

Figure 2:
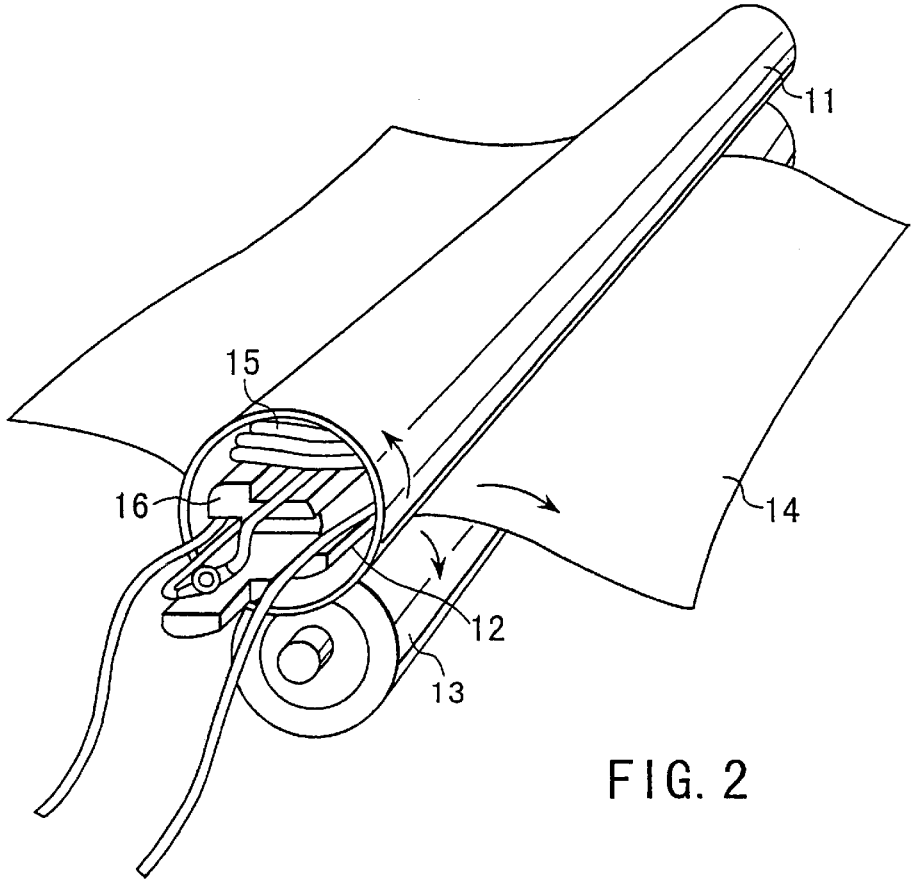
FIG. 2 is a perspective view illustrating a main portion of the fixing device according to Example 1.

FIG. 2 is a perspective view illustrating a main portion of the fixing device according to one embodiment of this invention. Referring to FIG. 2, the reference numeral 11 represents a conductor roller, which is designed to be rotated in the direction indicated by an arrow by way of a transmission means (not shown) which is disposed at an end portion in the axial direction of the conductor roller 11. A magnetic field-generating means 12 which is disposed inside the conductor roller 11 is enabled to generate an AC magnetic field by means of a high-frequency circuit (not shown), thereby causing an eddy current to generate in the conductor roller 11, thus allowing Joule heat to generate in the conductor roller 11.

A driven roller 13 is then pressed against the conductor roller 11 by means of a pressing mechanism (not shown) in such a manner as to secure a predetermined contacting width (nip width). This driven roller 13 is disposed rotatably, so that this driven roller 13 is enabled to rotate in the direction indicated by an arrow following the rotation of the conductor roller 11. A sheet-like material 14 is allowed to pass through a nip between the conductor roller 11 and the driven roller 13, thereby allowing an image to be fixed to the sheet-like material 14 by the effect of Joule heat.

In this example, the conductor roller 11 is made from an iron cylindrical body having an outer diameter of 40 mm and a thickness of 1.0 mm, and is provided therein with an excitation coil 15 as a magnetic field-generating means and also provided with a supporting member 16 supporting the coil 15 and made of a heat resistant resin. The sheet-like material 14 is made of paper, and a toner image that has been formed by way of an electrophotographic process is formed on the surface of the sheet-like material 14.

According to the coil of this example, since it comprises no core, it is required to actuate the performance of the coil by making use of a high electric current. Therefore, the electric wire for constituting the coil member is required to be thick enough to withstand this high electric current. However, due to the known skin effect, it is impossible to employ a thick electric wire but to employ litz wire. By the way, in this example, a litz wire consisting of 19 heat resistant enamel wires (polyimide cladding), each 0.5 mm in thickness and stranded together, were employed. The coil member is formed of 14 turns of the wires.

The enamel wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

However, even if this litz wire is employed, the copper loss of electric wire per se would become prominent if a large current is passed therethrough, so that heat radiation is required to be performed. Therefore, the heat radiation is required to be positively performed by minimizing the volume of the supporting member supporting the coil.

It is possible, by minimizing the volume of the supporting member, to reduce the quantity of an expensive heat resistance material, thereby making it possible to construct the fixing device at low cost and to lower the heat capacity. Therefore, it is possible to further promote a rapid temperature rise which is one of the advantages of the induction heating system as proposed by this invention.

Therefore, in this example, the structure of supporting member is limited to that is required to maintain the shape of the coil member. Namely, as shown in FIG. 2, the supporting member 21 is constituted by a plurality of partitioned supporting components 22. The number of the supporting components 22 for constituting the supporting member 21 is optional.

Further, since copper wire is left to stand in an environment for maintaining the fixability of roller (for the purpose of maintaining the roller at a temperature of around 200° C.), the coil member may possibly be twisted due to the stretching of the wire. Therefore, it is preferable, in view of preventing this phenomenon, to connect these dispersively disposed supporting components 22 with each other by means of a beam-like connecting member 23.

Figure 4:
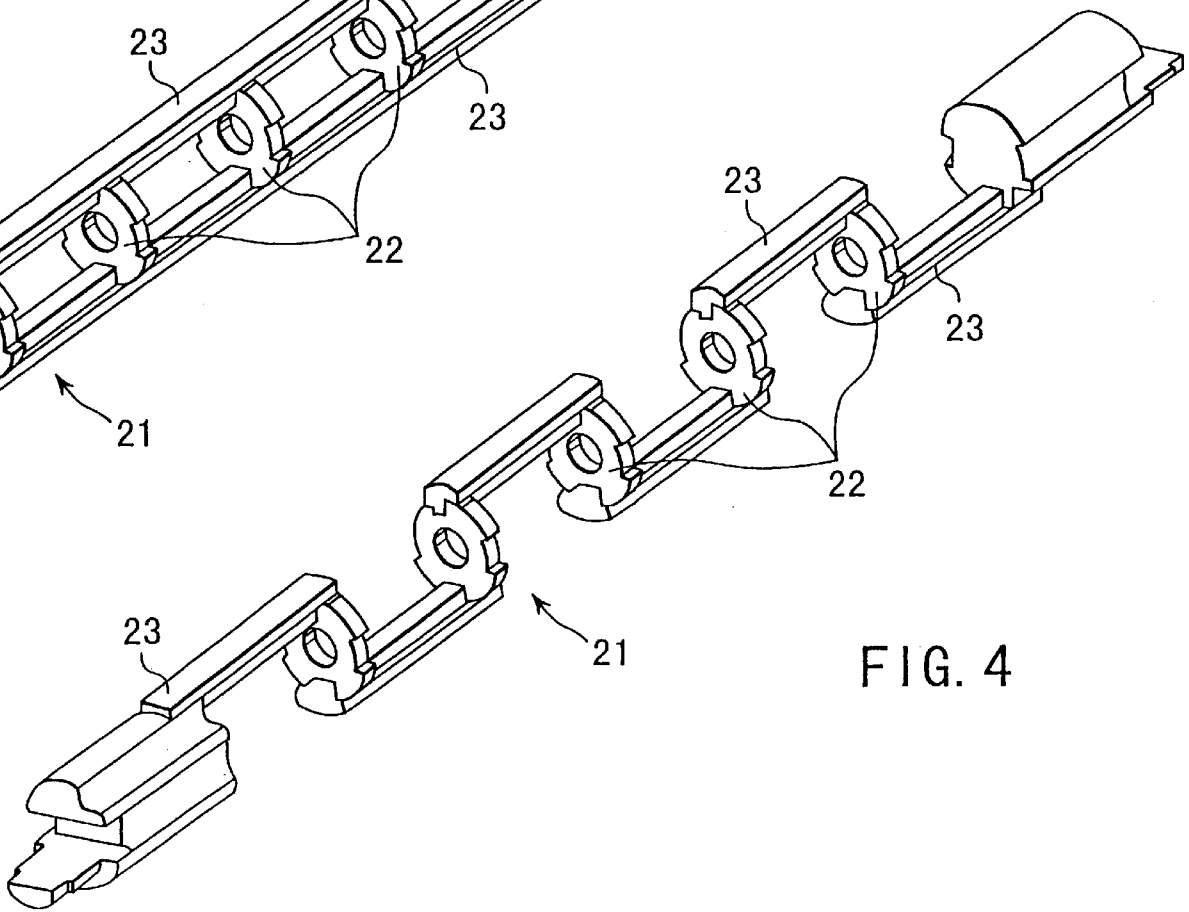
FIG. 4 is a perspective view illustrating a modified example of the supporting member of the fixing device shown in FIG. 2.
Figure 3:
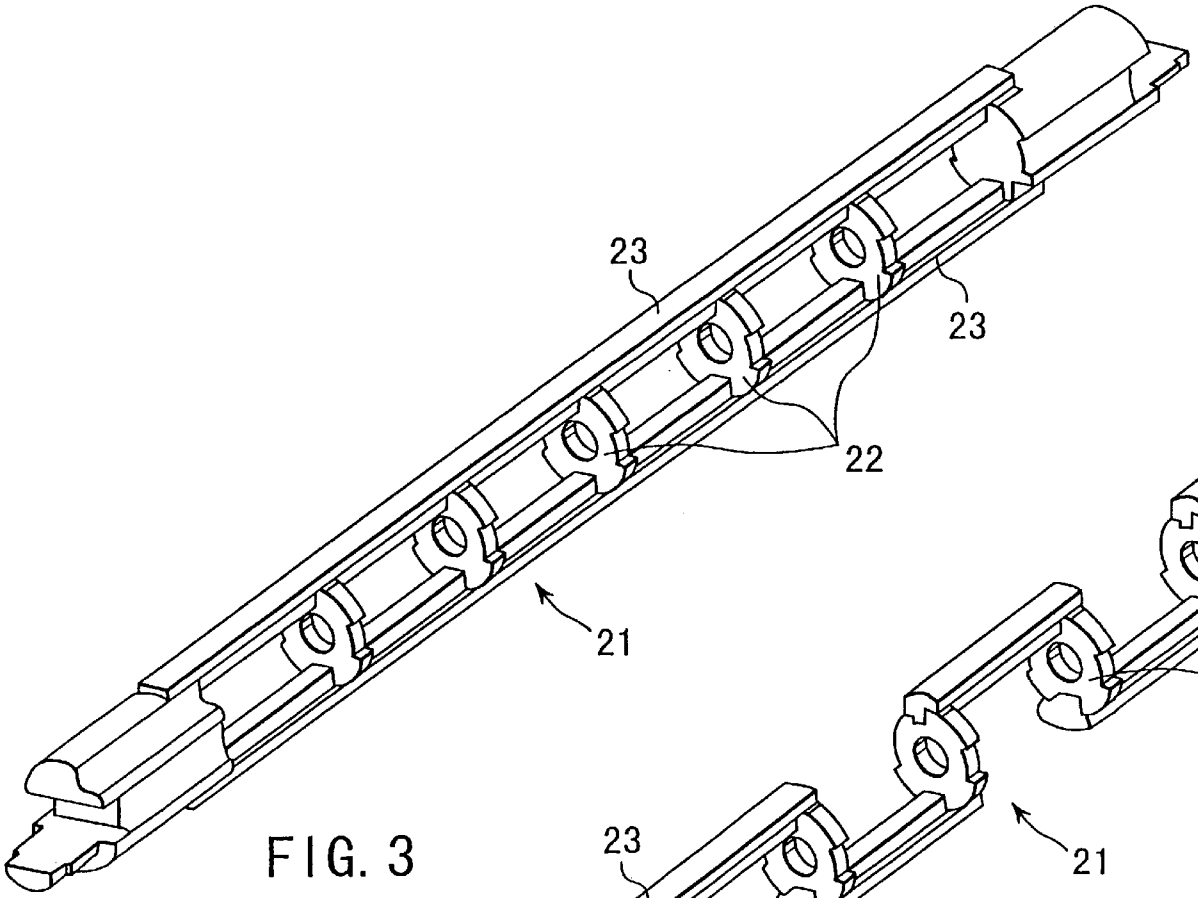
FIG. 3 is a perspective view illustrating the supporting member of the fixing device shown in FIG. 2.

In this case, when this connecting member 23 is positioned at the central space of the winding of the coil member, it would be useful for maintaining the configuration of this central portion of the winding, thereby enabling the connecting member 23 to be utilized also as a guide on the occasion of molding the coil member. By the way, in the structure shown in FIG. 3, the connecting member 23 is constituted by a pair of rod-like members which are disposed symmetrically. However, the connecting member 23 may be constituted by a plurality of short rod-like members which are alternately bridged to each other as shown in FIG. 4.

By the way, if the supporting components 22 are fixed in place by means of a predetermined jig on the occasion of winding the coil member, the employment of the connecting member 23 as a guiding member may not necessarily be required.

Further, if it is desired to deliberately make the heat generation non-uniform by adjusting the gap between the coil member 15 and the roller 11, i.e. if it is desired to obtain a predetermined temperature distribution on the surface of the roller 11, it can be realized by suitably changing the configuration and position of this plural number of supporting components 22 that have been dispersively disposed. Furthermore, the performance of the coil member under the condition where the coil member is disposed to face the body to be heated (i.e. the roller 11) can be adjusted by changing the configuration and position of these supporting components 22 in this manner. Because the performance of the coil member is greatly influenced by the configuration of the coil member, and the configuration of the coil member is influenced by the configuration of the supporting member 21.

EXAMPLE 2

Figure 5A:
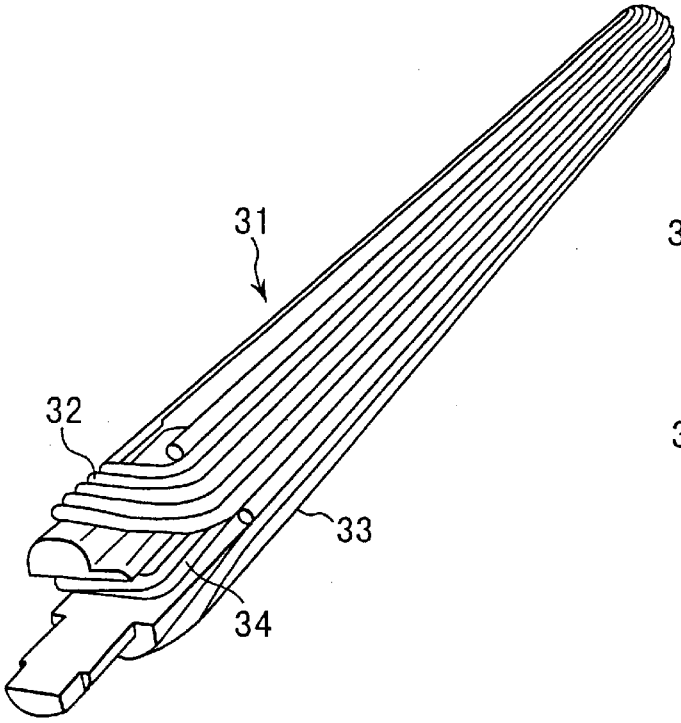
FIG. 5A is a perspective view illustrating the exciting coil of the fixing device according to Example 2.
Figure 5B:
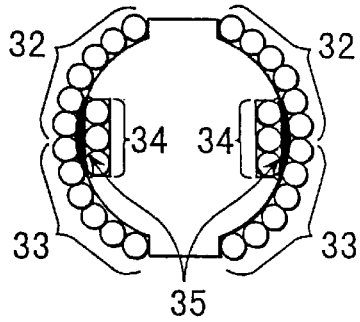
FIG. 5B is a cross-sectional view illustrating the exciting coil of the fixing device according to Example 2.

FIG. 5A is a perspective view illustrating the exciting coil of the fixing device according to one embodiment of this invention, while FIG. 5B is a cross-sectional view illustrating the manner of connecting the exciting coil. The coil member 31 is formed of 14 turns of wire comprising a copper wire having a diameter of 0.5 mm and a polyimide cladding having a thickness of 0.025 mm. In this case, 19 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 31 is constituted by a combination of three coil components 32, 33 and 34, i.e. a couple of outer coil components 32 and 33 and one inner coil 34, which are connected in series as shown in FIG. 5B. Depending on the manner of connecting these three wire components, a large potential difference may be generated between neighboring electric wire. For example, when current leak is generated between neighboring electric wires due to a defect or mechanical damage of cladding, the coil member 31 may be greatly damaged.

Therefore, according to the coil member of this example, the coil components 32 and 33 to be disposed on the outer side are connected with each other as shown in FIG. 5B, thereby suppressing a large potential difference from being generated between neighboring electric wires, i.e. between the coil components 32 and 33, and at the same time, the outer coil component 32 or 33 and the inner coil component 34 are connected with each other with an insulating material 35 being interposed between the inner coil component 34 and the outer coil component 32 or 33, thereby insulatively protecting these coil components.

By the way, according to this example, the coil member is covered by a 2-ply polyimide films. However, depending on the construction of the winding-supporting member, the insulation of the coil member can be realized without employing the insulating material 35.

EXAMPLE 3

Figure 6:
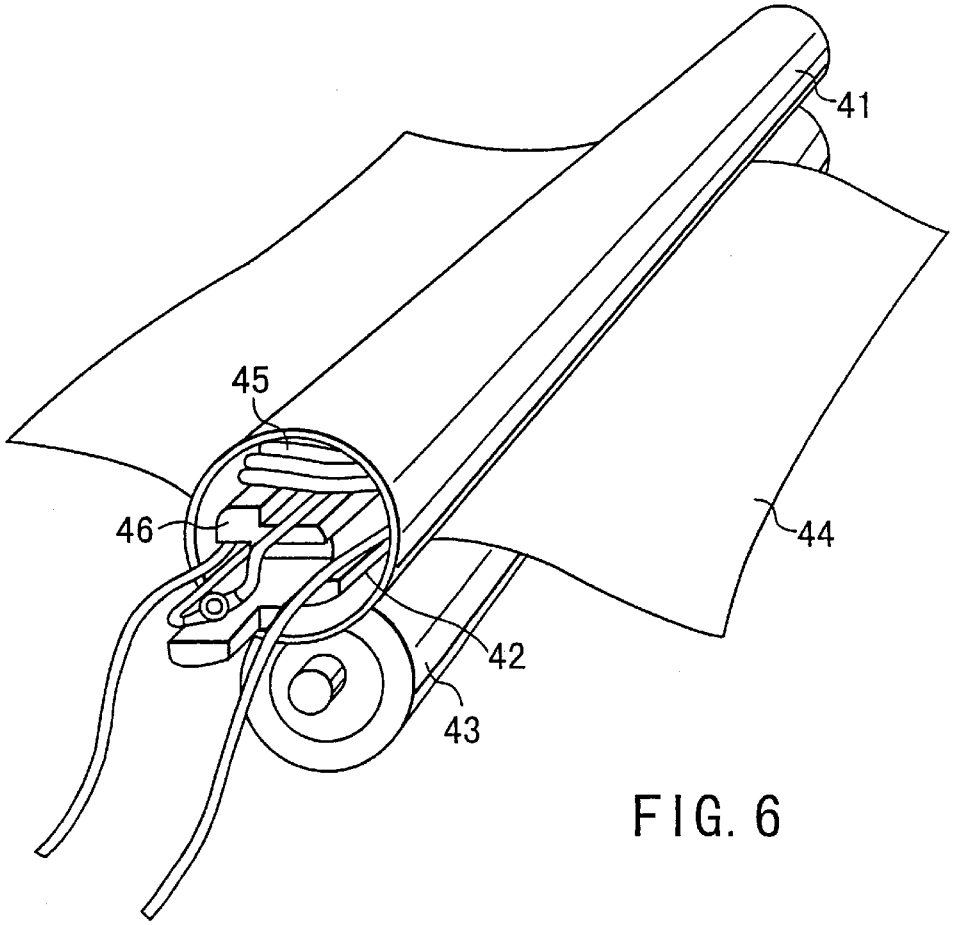
FIG. 6 is a perspective view illustrating a main portion of the fixing device according to Example 3.

FIG. 6 is a perspective view illustrating a main portion of the fixing device according to another embodiment of this invention. Referring to FIG. 6, the reference numeral 41 represents a conductor roller, which is designed to be rotated in the direction indicated by an arrow by way of a transmission means (not shown) which is disposed at an end portion in the axial direction of the conductor roller 41. A magnetic field-generating means 42 which is disposed inside the conductor roller 41 is enabled to generate an AC magnetic field by means of a high-frequency circuit (not shown), thereby causing an eddy current to generate in the conductor roller 41, thus allowing Joule heat to generate in the conductor roller 41.

A driven roller 43 is then pressed against the conductor roller 41 by means of a pressing mechanism (not shown) in such a manner as to secure a predetermined contacting width (nip width). This driven roller 43 is disposed rotatably, so that this driven roller 43 is enabled to rotate in the direction indicated by an arrow following the rotation of the conductor roller 41. A sheet-like material 44 is allowed to pass through a nip between the conductor roller 41 and the driven roller 43, thereby allowing an image to be fixed to the sheet-like material 44 by the effect of Joule heat.

In this example, the conductor roller 41 is made from an iron cylindrical body having an outer diameter of 40 mm and a thickness of 1.0 mm, and is provided therein with an excitation coil 45 as a magnetic field-generating means and also provided with a supporting member 46 supporting the coil 45 and made of a heat resistant resin. The sheet-like material 44 is made of paper, and a toner image that has been formed by way of an electrophotographic process is formed on the surface of the sheet-like material 44.

The coil member 45 is formed of 14 turns of wire comprising a copper wire having a diameter of 0.5 mm and a polyimide cladding having a thickness of 0.025 mm. In this case, 19 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 45 is constituted by a combination of three coil components, which are connected in series as shown in the above FIG. 5B. The electric wire extended from the coil member formed of these three coil components which are connected with each other is connected with a driving circuit. In this case however, this electric wire also generates a magnetic field and at the same time, may become a cause for the generation of noise affecting the external environment.

In view of this phenomenon, a countermeasure of covering the electric wire with a conductive body such as a metal is generally taken. In this case however, the length of electric wire may be formed as short as possible, and at the same time, the cladding for shielding the noise may be minimized, thereby making it possible to miniaturize the device and to save the manufacturing cost.

According to this example, the fixing device is constructed such that a couple of lead wires is disposed on one side of the axis of the roller. Additionally, in order to shorten the length of the lead wires, they are directed in the direction approaching close to the driving circuit. The structure wherein a couple of lead wires are disposed on one side of the axis of the roller can be realized by winding the coil member in such a manner that a 0.5 turn is not included in the turns of the coil member.

By the way, for the purpose of shielding the noise to be generated from the electric wire, an iron cladding may be formed on the electric wire. As required, an earth may be connected so as to allow the electric potential of the cladding to become zero.

EXAMPLE 4

Figure 7:
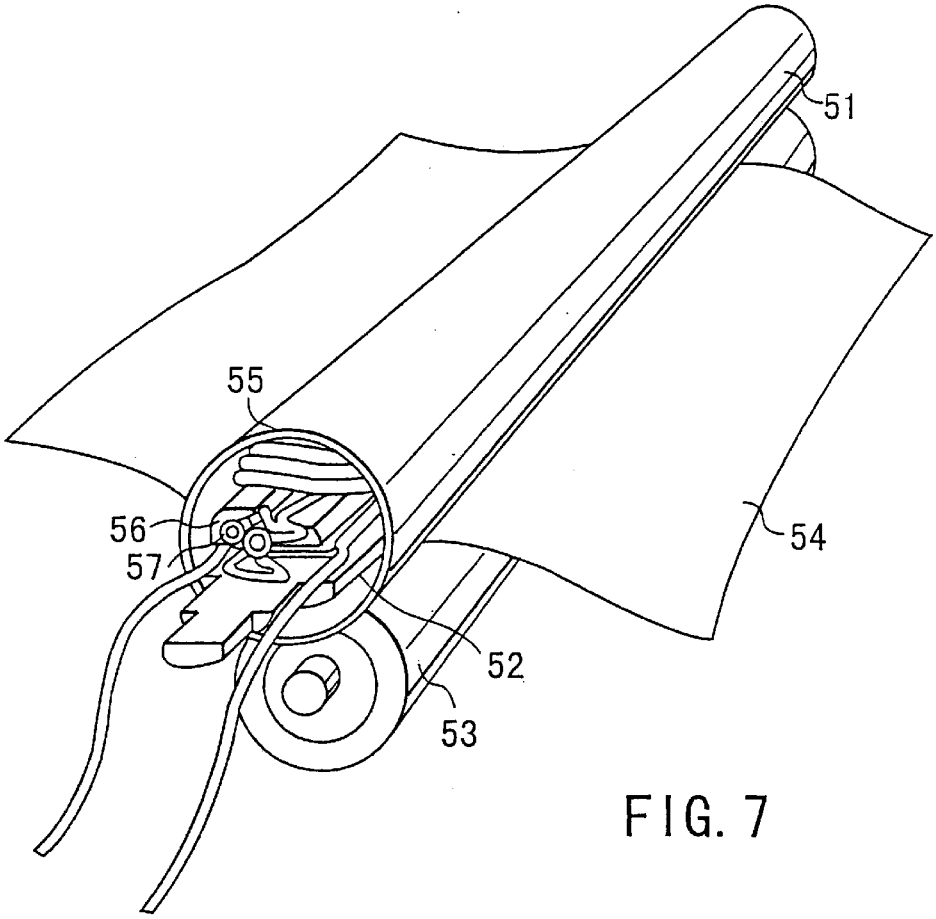
FIG. 7 is a perspective view illustrating a main portion of the fixing device according to Example 4.

FIG. 7 is a cross-sectional view illustrating a main portion of the fixing device according to another embodiment of this invention. Referring to FIG. 7, the reference numeral 51 represents a conductor roller, which is designed to be rotated in the direction indicated by an arrow by way of a transmission means (not shown) which is disposed at an end portion in the axial direction of the conductor roller 51. A magnetic field-generating means 52 which is disposed inside the conductor roller 51 is enabled to generate an AC magnetic field by means of a high-frequency circuit (not shown), thereby causing an eddy current to generate in the conductor roller 51, thus allowing Joule heat to generate in the conductor roller 51.

A driven roller 53 is then pressed against the conductor roller 51 by means of a pressing mechanism (not shown) in such a manner as to secure a predetermined contacting width (nip width). This driven roller 53 is disposed rotatably, so that this driven roller 53 is enabled to rotate in the direction indicated by an arrow following the rotation of the conductor roller 51. A sheet-like material 54 is allowed to pass through a nip between the conductor roller 51 and the driven roller 53, thereby allowing an image to be fixed to the sheet-like material 54 by the effect of Joule heat.

In this example, the conductor roller 51 is made from an iron cylindrical body having an outer diameter of 40 mm and a thickness of 1.0 mm, and is provided therein with an excitation coil 55 as a magnetic field-generating means and also provided with a supporting member 56 supporting the coil 55 and made of a heat resistant resin. The sheet-like material 54 is made of paper, and a toner image that has been formed by way of an electrophotographic process is formed on the surface of the sheet-like material 54.

The coil member 55 is formed of 14 turns of wire comprising a copper wire having a diameter of 0.5 mm and a polyimide cladding having a thickness of 0.025 mm. In this case, 19 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 55 is constituted by a combination of three coil components, which are connected in series as shown in the above FIG. 5B.

For the purpose of connecting coil member which is high in heat resistance temperature and excellent in chemical resistance, it is required to mechanical peel off each of the cladding of 19 wires which are stranded into a strand wire. Further, for the purpose of connecting these coil members with each other, a connecting fitting which is capable of sufficiently withstanding a peak current exceeding 60A is required to be used for this connection.

Accordingly, for the purpose of connecting such a coil member, an electric wire having some degree of length is required to be taken out from the coil member and worked. When the electric wire is extended in this manner, it is required to prevent noise from being generated from this extended portion.

According to this example, connecting portions 57 are disposed in the same direction as that of extending a lead wire to be connected with the driving circuit of the coil member, and at the same time, at least one of these connecting portions 57 is inserted inside the coil member. Due to this construction, it is now possible to simplify and miniaturize the member to be employed for preventing noise from being generated from the connected portion.

EXAMPLE 5

Figure 8A:
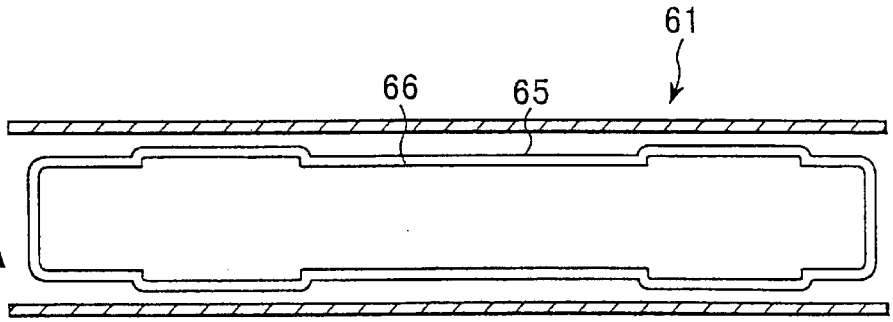
FIGS. 8A and 8B are cross-sectional views respectively showing a conductor roller of the fixing device according to Example 5.
Figure 8B:
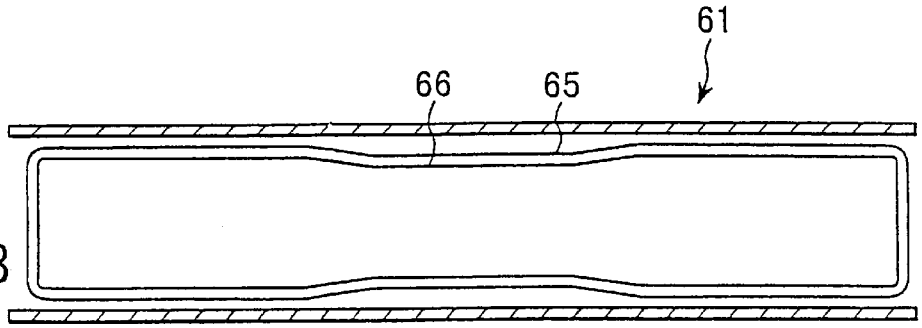

FIGS. 8A and 8B are cross-sectional views respectively showing a conductor roller of the fixing device according to another embodiment of this invention. As shown in FIGS. 8A and 8B, an exciting coil 65 and a supporting member 66 formed of a heat resistant resin for supporting the exciting coil 65 is placed, as a magnetic field-generating means, inside a conductor roller 61.

In the case of so-called air-core coil where no magnetic core material is disposed inside the coil as employed in the fixing device of this invention, a winding-supporting member is required to be employed in order to retain the configuration of coil during or after the molding thereof. Therefore, the external configuration of coil member is determined by the configuration of this supporting member.

Further, in contrast to a system wherein a magnetic material is placed inside and a magnetic flux that has been generated is concentrated at the core thereof, the system employed in this invention is featured in that the external configuration of coil gives a great influence to the characteristics of the coil. In particular, if it is required to obtain a uniform surface temperature of the coil member or to form a desired temperature distribution on the surface of the coil member, it can be effectively realized by changing the external configuration of the coil member or by changing the gap between the coil member and the roller.

In this example, as shown in FIG. 8A, the outer diameter of the supporting member 66 is altered by a magnitude of 2 mm along the axial direction of the roller 61. Namely, the central portion as well as both end portions are made smaller in diameter. Further, if it is desired to realize a gradual change in temperature along the axial direction of the roller 61, a tapered portion is formed as shown in FIG. 8B, thereby gradually changing the gap between the coil member 65 and the roller 61. When the supporting member 66 is constructed in this manner, the non-uniformity of surface-temperature of the roller 61 can be minimized to 10° C. at the moment when a recording paper is not passed therethrough. According to this example, the surface temperature of the roller 61 can be controlled to a desired value, thereby making it possible to stabilize the fixing performance of the fixing device.

EXAMPLE 6

FIGS. 9A and 9B respectively illustrates a main portion of the fixing device according to another embodiment of this invention. Referring to FIGS. 9A and 9B, the reference numeral 71 represents a conductor roller, which is designed to be rotated in the direction indicated by an arrow by way of a transmission means (not shown) which is disposed at an end portion in the axial direction of the conductor roller 71. A magnetic field-generating means 72 which is disposed inside the conductor roller 71 is enabled to generate an AC magnetic field by means of a high-frequency circuit (not shown), thereby causing an eddy current to generate in the conductor roller 71, thus allowing Joule heat to generate in the conductor roller 71.

A driven roller 73 is then pressed against the conductor roller 71 by means of a pressing mechanism (not shown) in such a manner as to secure a predetermined contacting width (nip width). This driven roller 73 is disposed rotatably, so that this driven roller 73 is enabled to rotate in the direction indicated by an arrow following the rotation of the conductor roller 71. A sheet-like material 74 is allowed to pass through a nip between the conductor roller 71 and the driven roller 73, thereby allowing an image to be fixed to the sheet-like material 74 by the effect of Joule heat.

In this example, the conductor roller 71 is made from an iron cylindrical body having an outer diameter of 40 mm and a thickness of 1.0 mm, and is provided therein with an excitation coil 75 as a magnetic field-generating means and also provided with a supporting member 76 supporting the coil 75 and made of a heat resistant resin. The sheet-like material 74 is made of paper, and a toner image that has been formed by way of an electrophotographic process is formed on the surface of the sheet-like material 74.

The coil member 75 is formed of 14 turns of wire comprising a copper wire having a diameter of 0.5 mm and a polyimide cladding having a thickness of 0.025 mm. In this case, 19 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 75 is constituted by a combination of three coil components, which are connected in series as shown in the above FIG. 5B.

For the purpose of connecting coil member which is high in heat resistance temperature and excellent in chemical resistance, it is required to mechanical peel off each of the cladding of 19 wires which are stranded into a strand wire. Further, for the purpose of connecting these coil members with each other, a connecting fitting which is capable of sufficiently withstanding a peak current exceeding 60A is required to be used for this connection.

In the structure employing a large electric current and a large voltage, it becomes important to take some countermeasure for the prevention of current leak. According to the prior art, as this countermeasure, a circular terminal is employed for treating the terminal portions and a screw is employed for fastening the device.

By contrast, according to this example, as shown in FIG. 9B, a metallic sleeve 78 is employed for the connection between electric wires 77*a* and 77*b*, and the metallic sleeve 78 is covered by a heat resistant tube, e.g. a silicon tube 79. By the way, a polyimide tube may be employed substituting for the silicon tube 79.

According to this example, since the aforementioned connecting system is adopted, the connection or electric wires can be made into a permanent connection, and the structure of the connection can be simplified, thus making it possible to save the manufacturing steps and to realize an integral connection which is suited for the miniaturization thereof.

EXAMPLE 7

FIG. 10 is a cross-sectional view illustrating a main portion of the fixing device according to another embodiment of this invention. Referring to FIG. 10, the reference numeral 81 represents a conductor roller, which is designed to be rotated in the direction indicated by an arrow by way of a transmission means (not shown) which is disposed at an end portion in the axial direction of the conductor roller 81. A magnetic field-generating means 82 which is disposed inside the conductor roller 81 is enabled to generate an AC magnetic field by means of a high-frequency circuit (not shown), thereby causing an eddy current to generate in the conductor roller 81, thus allowing Joule heat to generate in the conductor roller 81.

A driven roller 83 is then pressed against the conductor roller 81 by means of a pressing mechanism (not shown) in such a manner as to secure a predetermined contacting width (nip width). This driven roller 83 is disposed rotatably, so that this driven roller 83 is enabled to rotate in the direction indicated by an arrow following the rotation of the conductor roller 81. A sheet-like material 84 is allowed to pass through a nip between the conductor roller 81 and the driven roller 83, thereby allowing an image to be fixed to the sheet-like material 84 by the effect of Joule heat.

In this example, the conductor roller 81 is made from an iron cylindrical body having an outer diameter of 40 mm and a thickness of 1.0 mm, and is provided therein with an excitation coil 85 as a magnetic field-generating means and also provided with a supporting member 86 supporting the coil 85 and made of a heat resistant resin. The sheet-like material 84 is made of paper, and a toner image that has been formed by way of an electrophotographic process is formed on the surface of the sheet-like material 84.

The coil member 85 is formed of 14 turns of wire comprising a copper wire having a diameter of 0.5 mm and a polyimide cladding having a thickness of 0.025 mm. In this case, 18 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 85 is constituted by a combination of three coil components, which are connected in series as shown in the above FIG. 5B.

According to the magnetic field-generating means which is constructed as explained above and placed inside the conductor roller, it is possible to obtain a value of about 28 $\mu$H and to enable it to oscillate by connecting the coil member to a quasi-E class driving circuit where AC of 100V is flattened.

However, there are some regions where the voltage actually employed is AC of 200V which is twice as high as 100V. Therefore, it is a very important subject matter to enable the device to be used in such regions. As a matter of fact, in the regions where AC of 200V is actually employed, it is impossible to employ the same coil member under the same output conditions.

Figure 11A:
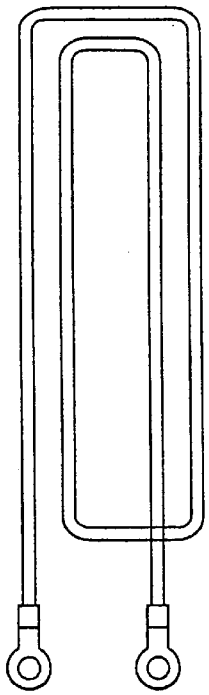
FIGS. 11A and 11B are plan views respectively showing the construction of coil member of the fixing device according to Example 7.

Therefore, in order to enable the winding-supporting member and mold of AC100V type to be employed in such regions, 18 strand wires are separated by the color of cladding into two kinds, i.e. nine electric wires A and nine electric wires B as shown in FIG. 11A, and then, a strand work is performed. If the coil member is to be employed in a region where AC of 200V is adopted, nine electric wires A and nine electric wires B, each having the same color, are separately stranded and then connected in series with the connecting portion C, thereby obtaining a coil member having a cross-sectional area reduced to ½ and a number of turns increased twice. As a result, the inductance of coil can be increased to 110 $\mu$H.

The switch-over of the connection between the electric wires A and the electric wires B can be performed using a change-over switch.

Figure 11B:
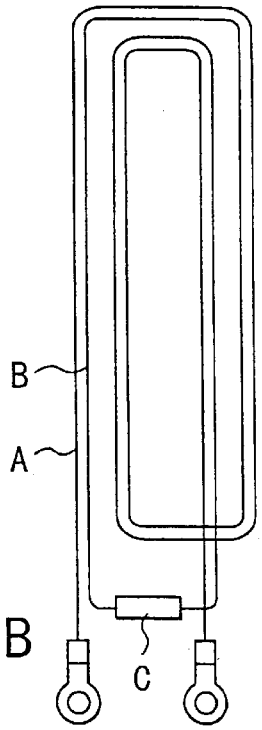
Figure 11C:
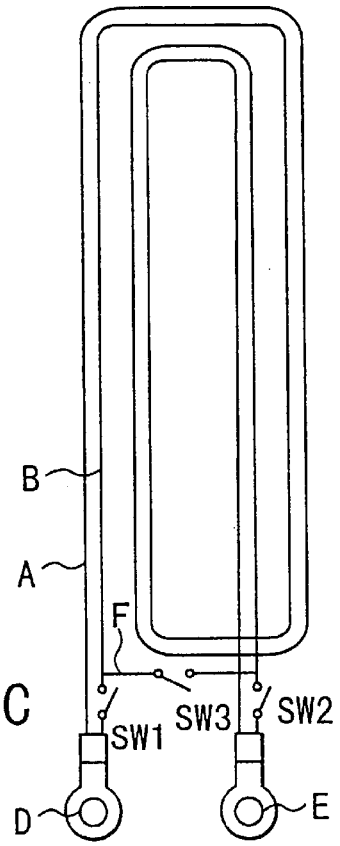
FIGS. 11C and 11D are plan views respectively showing other examples of the construction of coil member of the fixing device according to Example 7.

Namely, as shown in FIG. 11C, a switch (SW)1 is attached to the electric wires B disposed close to a terminal D, a switch (SW)2 is attached to the electric wires A disposed close to a terminal E, and additionally, a wiring F is interposed between the terminal D and the terminal E, the wiring F being provided further with a switch (SW)3. In this case, when the coil member is desired to be employed under the condition shown in FIG. 11A, the switch (SW)1 and switch (SW)2 are turned ON and the switch (SW)3 is turned OFF. On the other hand, when the coil member is desired to be employed under the condition shown in FIG. 11B, the switch (SW)1 and switch (SW)2 are turned OFF and the switch (SW)3 is turned ON. These three switches can be interlocked, thereby enabling them to be simultaneously opened or closed.

Figure 11D:
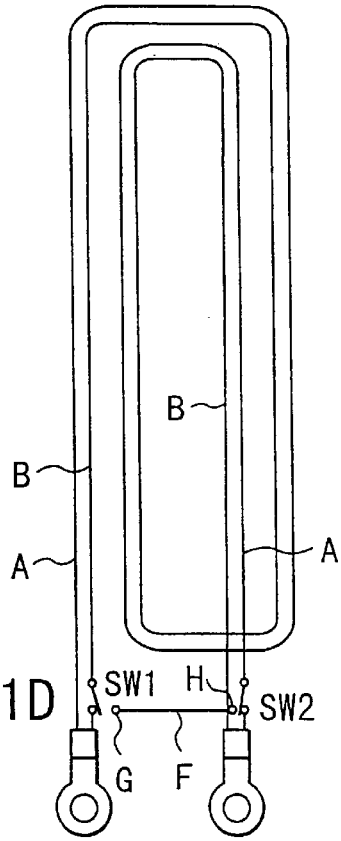

Although three switches are required in the embodiment shown in FIG. 11C, the number of switch can be reduced to two as shown in FIG. 11D. Namely, the wiring F may be interposed between the terminal D and the terminal E, and then, the switch (SW)1 for effecting the change-over between the terminal G of the wiring F and the electric wires B of the terminal D as well as the switch (SW)2 for effecting the change-over between the terminal H of the wiring F and the electric wires A of the terminal E may be disposed. These two switches can be interlocked, thereby enabling them to be simultaneously changed.

It is possible, with this construction, to cope with a plurality of different electric voltage under the common working condition. Although an example for coping with a doubled electric voltage has been explained in the foregoing example, the method can be also applied to any other electric voltage. It is of course required in this case to enhance the withstand voltage of the elements in the driving circuit.

EXAMPLE 8

Figure 12A:
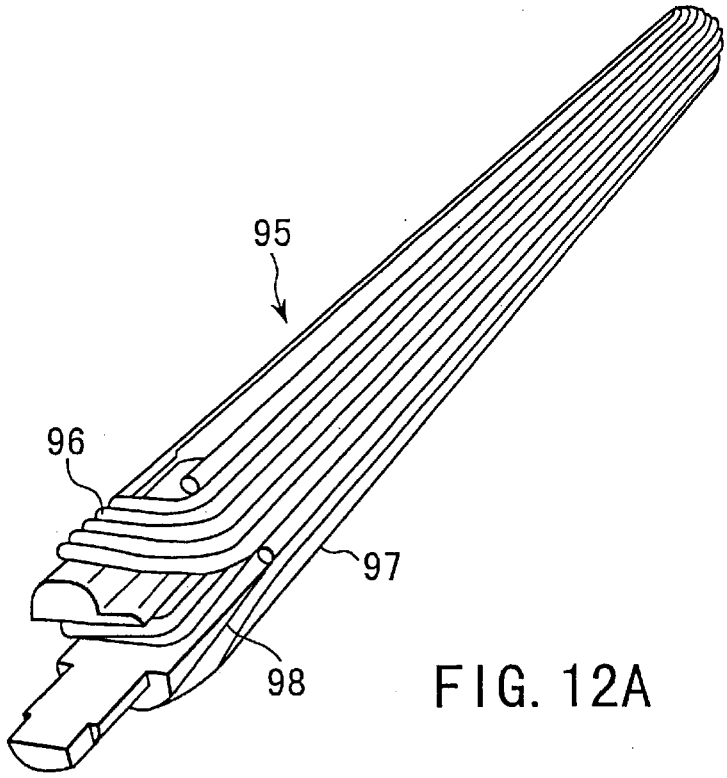
FIG. 12A is a perspective view illustrating the exciting coil of the fixing device according to Example 8.
Figure 12B:
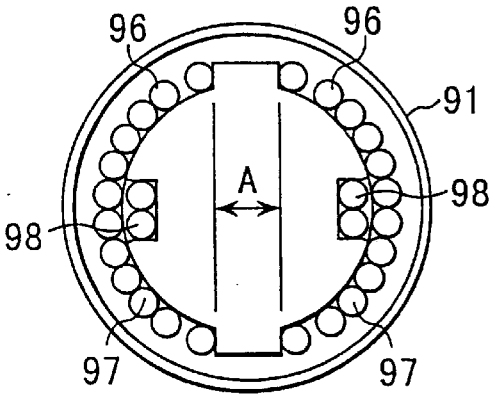
FIGS. 12B and l2C are cross-sectional views illustrating, respectively, the exciting coil of the fixing device according to Example 8.
Figure 12C:
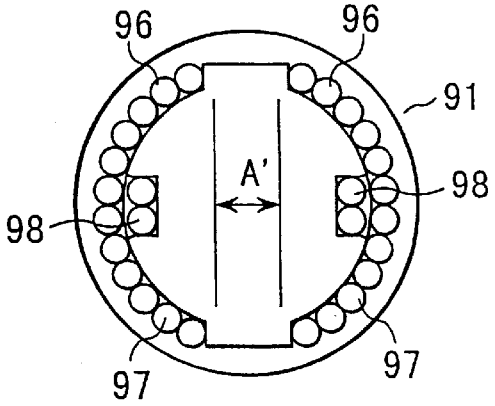

FIG. 12A is a perspective view illustrating the exciting coil of the fixing device according to another embodiment of this invention, and FIGS. 12B and 12C are cross-sectional views illustrating, respectively, the arrangement of exciting coil 95 disposed inside a conductor roller 91, wherein FIG. 12B shows the central portion, while FIG. 12C shows the opposite end portions.

The coil member 95 is formed of 14 turns of wire comprising a copper wire having a diameter of 0.5 mm and a polyimide cladding having a thickness of 0.025 mm. In this case, 19 wires are stranded to form a litz wire.

The wires and the supporting member may be bonded to each other by means of heat resistant varnish or resin to maintain its configuration, if necessary. Furthermore, a heat resistant and electric insulating covering may be formed on the bonded structure in order to protect the surface of the bonded structure and to prevent the bonded structure from being contact with the conductor roller.

For the purpose of simplification of molding, the coil member 95 is constituted by a combination of three coil components 96, 97 and 98, which are connected in series as shown in the above FIG. 5B.

In the case of so-called air-core coil where no magnetic core is disposed inside the coil as employed in the system of this invention, the characteristics of the coil member is greatly influenced by the external configuration of the coil, and hence the distribution of heat generation of the coil member is also influenced by the external configuration of the coil. According to the prior art, this non-uniformity of temperature is tried to be prevented by mainly altering the gap between the coil member and the conductor giving a load (i.e. the roller in this example). As a matter of fact however, there is a limitation on the alteration of the gap, so that if the conductor is moved too close to the coil member, it may become impossible to secure a designed clearance on the occasion of the thermal expansion of the coil member, etc.

Therefore, according to this example, a system which enables to obtain the same effect without necessitating the alteration of gap between the coil member and roller is adopted. In the case of so-called air-core coil where no magnetic core is disposed inside the coil, the central space thereof gives a great influence to an attempt to effectively utilize the magnetic flux that has been generated. Namely, when this central space is too small, the engagement thereof with the roller giving a load will be weakened even if the number of turns is increased. Therefore, when the quantity of magnetic flux to be functioned is changed along the axial direction of the roller by changing the width of this central space along the axial direction of the roller, the quantity of heat generation of the roller can be altered in the axial direction thereof.

In this example, the width A of the space at the central portion thereof is narrowed as shown in FIG. 12B, and at the same time, the width A' of the space at the opposite end portions thereof is expanded as shown in FIG. 12C. In this example, the arrangement of one turn at the central portion of the coil member which has been disposed at the outermost periphery is narrowed by 3 mm at the central portion in the axial direction thereof, thereby deliberately decreasing the quantity of heat generation at the central portion in the axial direction thereof. However, depending on the number of coils to be changed or depending on the distance of the change, the effect to be derived therefrom would be, of course, differed. It is of course possible to obtain the aforementioned effect by applying this procedure to only part of the plural number of coil units as set forth in this example.

Additionally, when the fluctuation of width of the space as set forth in this example is combined with the fluctuation of gap as set forth in Example 5 (FIGS. 8A and 8B), a more increased effect can be of course obtained. When the width of this space is changed by an actuator for the purpose of controlling the distribution of heat generation so as to conform it with the size of paper, it would be possible to obtain a heat generation which is optimum for the paper size, thereby making it possible to prevent the generation of abnormal heating in the vicinity of the bearings disposed at both ends of the roller.

As explained above, by adopting various constructions of the coil member and the supporting member both constituting the induction heating mechanism, the efficiency of heat generation can be optimized and at the same time, uniform heating of the roller can be realized, thus making it possible to obtain a fixing device which is excellent in fixing performance and can be manufactured at low cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device comprising;

an endless heating member which is adapted to be moved at the same velocity as a transferring speed of a sheet-like member with an image thereon and is adapted to be contacted with the sheet-like member to thereby enable the image on the sheet-like member to be thermally fixed; and an induction heating mechanism for performing an induction heating of the endless heating member, wherein the induction heating mechanism comprises a coil member, and a supporting member for supporting the coil member; and the coil member is constituted by a plurality of litz wires which are designed to be altered in the manner of combination or of connection thereof, thereby enabling a plurality of different electric voltages to be applicable.

2. The fixing device according to claim 1, wherein said coil member comprises a pair of terminals which are connected with a power source, a first electric wire consisting of a plurality of litz wires, a second electric wire consisting of a plurality of litz wires, and a switch which is constructed such that said first electric wire can be connected with one of said pair of terminals by switching over said second electric wire and that said second electric wire can be connected with the other of said pair of terminals by switching over said first electric wire.

3. The fixing device according to claim 1, wherein said endless heating member is a heat roller.

* * * * *